United States Patent [19]

Aziz

[11] 4,176,835

[45] Dec. 4, 1979

[54] SIT-UP EXERCISING DEVICE

[76] Inventor: Edward D. Aziz, 47 Crosland Ave., Scarborough, Ontario, Canada

[21] Appl. No.: 869,586

[22] Filed: Jan. 16, 1978

[51] Int. Cl.[2] ..... A63B 21/00

[52] U.S. Cl. ..... 272/93; 272/900; 272/143

[58] Field of Search ..... 272/143, 144, 145, DIG. 4, 272/900, 116, 93

[56] References Cited

U.S. PATENT DOCUMENTS

| | | | |
|---|---|---|---|
| 2,046,653 | 7/1936 | Petcoff | 272/143 X |
| 2,050,652 | 8/1936 | Fleming | 272/143 X |
| 2,425,971 | 8/1974 | Walker | 272/900 |
| 3,134,592 | 5/1964 | Sharkey | 272/900 X |
| 3,966,200 | 6/1976 | Kirk | 272/144 X |
| 4,046,373 | 9/1977 | Kim | 272/144 X |

*Primary Examiner*—Richard C. Pinkham
*Assistant Examiner*—William R. Browne
*Attorney, Agent, or Firm*—Ridout & Maybee

[57] ABSTRACT

An exercising device for assisting in sit-up and leg-raising exercises has a frame with a flange adapted to be trapped beneath a door, the frame supporting a resilient foot engaging roller with shaft extensions which form hand grips. Hand grips extend out from the ends of the resilient roller.

1 Claim, 4 Drawing Figures

SIT-UP EXERCISING DEVICE

FIELD OF THE INVENTION

This invention relates to exercising devices, and more particularly devices designed to provide a floor level anchor for the feet or hands whilst engaging in floor exercises such as sit-ups and leg-raises.

BACKGROUND OF THE INVENTION

When carrying out certain types of floor exercises, such as sit-ups and leg-raises, it is difficult to prevent that portion of the body which is not intended to be raised from rising from the floor. People have arrived at various improvised solutions to this problem, for example by uncomfortable expedients such as tucking their hands or toes beneath heavy articles of furniture, and various purpose built restraints have also been devised for this function, but these have tended to lack versatility and have often been cumbersome in nature.

U.S. Pat. No. 2,050,652, issued Aug. 11, 1936 to Fleming, discloses a pair of foot engaging stirrups which are mounted on a frame which may be releasably clamped to the floor so as to engage beneath the lower edge of a door. U.S. Pat. No. 3,134,592, issued May 26, 1964 to Sharkey, discloses a foot restraining bar which is supported by a frame which may be clipped over the footboard of a bed. U.S. Pat. No. 3,287,016, issued Nov. 22, 1966 to Mayer, discloses a further device in which foot restraining stirrups are provided, although in this case they are carried by a free-standing frame. These devices are all intended only to engage the feet of the user, and neither of the stirrup devices provides comfortable and satisfactory hand grips, whilst the Sharkey device is only suited for use in conjunction with a footboard type bed. Most beds no longer have suitable footboards, and the bed mattress will often be too soft to provide a suitable exercising base. The Mayer device is necessarily rather bulky, and also must be fairly heavy if it is to provide the desired restraint. The clamps of the Fleming device are a disadvantage both because they may damage floor coverings and because the device may become insecure if they are not tightened properly. It is also desirable, in sit-up exercises, that the legs of the person concerned by slightly bent, since this lessens the risk of possible hernia: however, this both increases the downward restraint required on the feet and means that some support for the soles of the feet is required. It is doubtful whether the Mayer or Sharkey devices could reliably provide sufficient downward restraint, whilst none of the devices discussed supports the feet in such a manner as would restrain straightening of the knees.

U.S. Pat. No. 3,567,218, issued Mar. 2, 1971 to Johnson, describes an exercising device in which the feet of the user are engaged between two rubber covered rollers which respectively engage the soles and insteps of the feet of the user, the rollers being mounted on a support which also carries a stool across which the user performs bending exercises. Although this device provides a satisfactory anchorage for the feet of the user, the device as a whole is very bulky, and the large rubber covered rollers would not be satisfactory as hand grips. U.S. Pat.No. 3,966,200, issued June 29, 1976 to Kirk, is a device for stretching exercises, with separate hand and foot grips at opposite ends of the frame. Apart from the absence of any restraint against leg straightening, these grips would be satisfactory for individual use in leg-raising and sit-up exercises respectively, but the device as a whole is unduly bulky for this purpose, for which it is in any case not intended.

Exercising devices have also been proposed which have an anchor which hooks over or around a door, but these are arm exercising devices in which the door acts to anchor tension cords, as shown in U.S. Pat. Nos. 775,989 and 3,814,084 issued to Roberts and Gustafson respectively.

SUMMARY OF THE INVENTION

According to the invention, there is provided an exercising device for use in conjunction with a door, the device comprising a roller having a resilient surface and a length at lease equal to the width of two human feet, elongated hand grips extending beyond each of the ends of the roller by a distance at least equal to the width of a human hand, and a frame adapted to support said roller and said hand grips parallel to and adjacent the bottom of a door and the floor therebeneath in such manner as to allow unobstructed access to said roller and said handgrips respectively by the insteps and palms of a user, said frame having a floor engaging footing beneath the roller, a flange extending in the same plane as said footing and engageable with the bottom of the door, and at least one vertical door engaging surface spaced horizontally from the axis of said roller. Preferably the hand grips form extensions of a shaft by means of which the roller is journalled in the frame. Preferably also the frame has members providing two opposed vertical door engaging surfaces, connected only by said flange, and further vertical members flanking said roller, the shaft extensions projecting outwardly of said vertical members.

Further features of the invention will be apparent from the following description of a preferred embodiment.

SHORT DESCRIPTION OF THE DRAWING

In the drawing:

FIG. 1 is a perspective view of a preferred embodiment of the invention, from the front and one side, FIG. 2 is a further perspective view of the embodiment of FIG. 1, from the rear and the other side, and FIGS. 3 and 4 are views corresponding to FIG. 1, but on a reduced scale, showing the device in use.

DESCRIPTION OF THE PREFERRED EMBODIMENT

Figure 1:
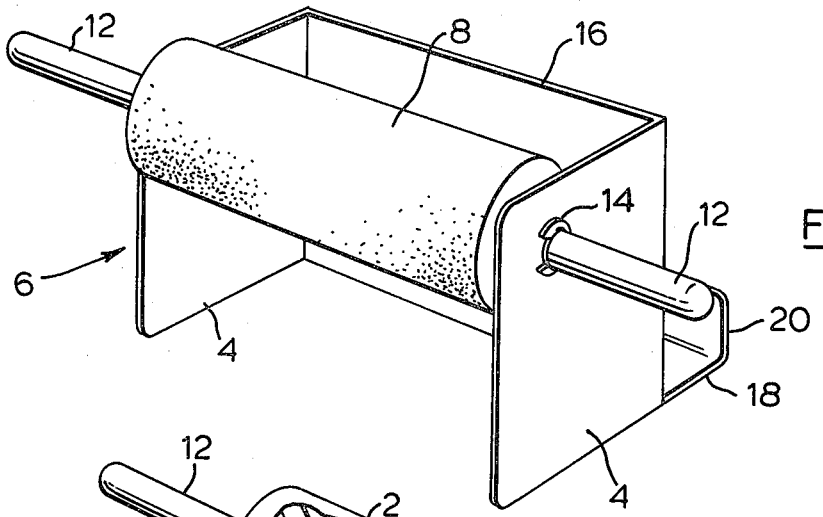
Figure 2:
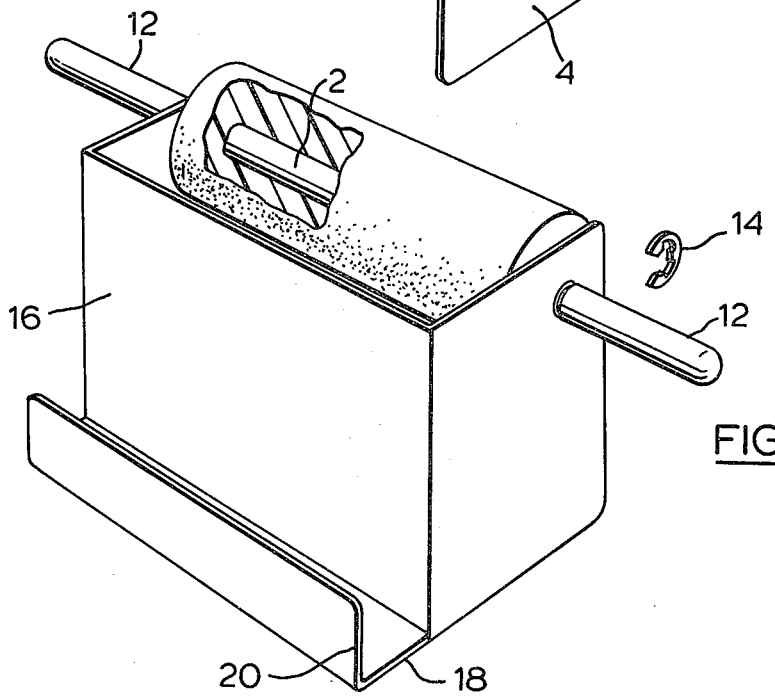

The exercise device shown in the drawing comprises a round wooden shaft 2, of a diameter providing a convenient grip for the hands of a user, for example about 0.875 inch, the shaft being journalled in apertures in side plates 4 of a frame 6 and passing through a roller 8 flanked by the side plates. The roller is of resilient foamed rubber or synthetic plastic, and is of a diameter providing for comfortable engagement with the insteps of a user, for example about 3 inches. The length of the roller should exceed the width of two normal human feet, about inches being a convenient length, and the length of the shaft should be such that its end portions 12 projecting beyond the roller and the side plates have a length at least equal to the width of a normal human hand so as to provide comfortable hand grips. The shaft is retained in position by means of circlips 14.

Besides the side plates 4, the frame 6 further comprises a back plate 16, a flange 18 and a flange portion 20. The vertical back plate 16 unites the side plates 4, its front surface provides a rest for the soles of the feet of a user, and its rear surface engages one side of a door 22 (see FIGS. 3 and 4) to which the device applies. The bottom edges of the plates 4 and 16 provide a footing for the frame, and the flange 18 extends behind the plate 16 in the same plane as the footing. The flange portion 20 extends vertically and provides a further vertical door engaging surface opposed to that provided by the plate 16 so as to trap the device securely beneath a closed door. The frame may be fabricated from metal, or moulded from a suitable high-tensile synthetic plastic material such as high density polypropylene, and is of such dimensions that there is ample clearance between the roller and the back plate and the floor to accommodate the feet 24 of a user.

Figure 4:
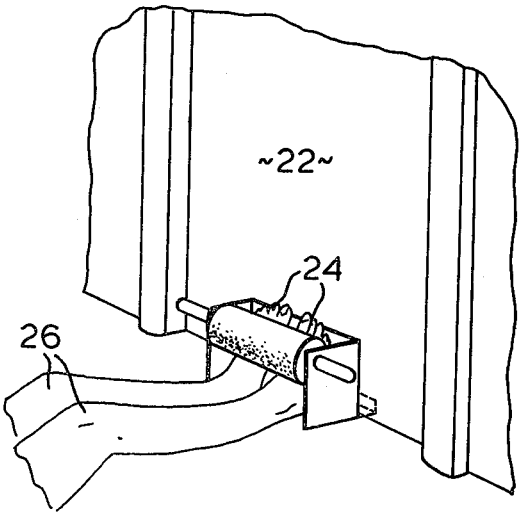

In use, the device is secured to a door by opening the latter, sliding the flange 18 beneath the bottom of the door, and closing the door. If the user desires to do sit-up exercises, the user's feet 24 are placed as shown in FIG. 4 so that the insteps can engage the roller. Preferably the knees 26 are slightly bent to reduce the risk of hernia, and the plate 16 engages the soles of the feet to help maintain this posture. The flange 18 restrains the device against upward movement, the flange portion 20 providing additional security.

Figure 3:
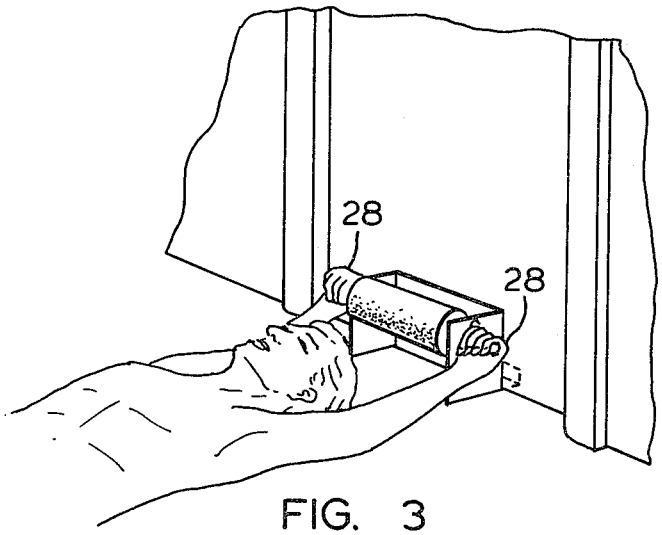

If the user wishes to carry out leg raising or other similar exercises involving lifting of the legs, the position shown in FIG. 3 may be assumed with the user's hands 28 gripping the readily accessible end portions 12 of the shaft.

It would be possible to omit the flange portion 20, at the risk of some loss of security, and provided that no restraint was required against forces tending to pull the device away from the door. In the alternative, omission of the plate 16 would be possible provided that the remaining parts of the frame were suitably connected, since provided that the flange portion 20 was present, the door itself would act as a restraint for the soles of the user's feet. Whilst from the point of view of a comfortable hand grip, it is advantageous that the shaft 20 be rotatably mounted, it would be possible to use separate hand grips mounted on the frame independently of the roller. Likewise, the frame could be rearranged so that the shaft is journalled at its outer extremities, the portions gripped by the hands being within the plates 4. It will thus be understood that variations are possible in the embodiment of the invention described, and all such variations are part of my invention insofar as they fall within the scope of the appended claims.

What I claim is:

1. An exercising device for use in conjunction with a door, comprising a roller having a resilient surface and a length at least equal to the width of two human feet; a frame having side walls and a rear wall presenting a rearward facing door engaging surface, said frame having a floor engaging footing extending in a horizontal plane beneath the roller; a shaft supporting the roller between the side walls and having coaxial extensions passing through said side wall to form elongated generally cylindrical hand grips extending beyond each of the side walls by a distance at least equal to the width of a human hand, the frame having a flange extending rearwardly of the rear wall in the same horizontal plane as said footing and engageable with the bottom of a door, and a further flange upstanding from said rearwardly extending flange and having a forward facing vertical door engaging surface, the frame being so configured that when the rear wall and the flanges are engaged with the faces and bottom of a door and the floor engaging footing is engaged with a floor beneath the door, said roller and said hand grips are supported for rotation on a common axis parallel to and adjacent the bottom of the door and the floor therebeneath in a position such as to allow unobstructed access to said roller and said hand grips respectively by the insteps and palms of a user with said rear wall providing a rest for the soles of a user's feet when the user's insteps are engaged beneath the roller.

* * * * *